United States Patent [19]

Ray et al.

[11] Patent Number: 4,584,172

[45] Date of Patent: Apr. 22, 1986

[54] METHOD OF MAKING COMPOSITION SUITABLE FOR USE AS INERT ELECTRODE HAVING GOOD ELECTRICAL CONDUCTIVITY AND MECHANICAL PROPERTIES

[75] Inventors: Siba P. Ray, Pittsburgh, Pa.; Robert A. Rapp, Columbus, Ohio

[73] Assignee: Aluminum Company of America, Pittsburgh, Pa.

[21] Appl. No.: 596,020

[22] Filed: May 3, 1984

Related U.S. Application Data

[62] Division of Ser. No. 423,673, Sep. 27, 1982, Pat. No. 4,454,015.

[51] Int. Cl.[4] ..... B22F 3/16; C22C 38/08

[52] U.S. Cl. ..... 419/34; 419/45; 419/46; 419/48; 419/49

[58] Field of Search ..... 419/45, 46, 48, 49, 419/10; 252/425.3; 204/293

[56] References Cited

U.S. PATENT DOCUMENTS

| | | | |
|---|---|---|---|
| 1,848,002 | 3/1932 | Cain | 204/281 |
| 3,960,678 | 6/1976 | Alder | 204/67 |
| 4,187,155 | 2/1980 | DeNora et al. | 204/67 |
| 4,374,060 | 2/1983 | Ray | 252/519 |
| 4,374,761 | 2/1983 | Ray | 252/519 |
| 4,392,927 | 7/1983 | Fabian et al. | 204/98 |
| 4,399,008 | 8/1983 | Ray | 204/67 |
| 4,455,211 | 6/1984 | Ray | 204/293 |

FOREIGN PATENT DOCUMENTS

| | | | |
|---|---|---|---|
| 534732 | 7/1976 | Japan | 204/293 |

OTHER PUBLICATIONS

"Displacement Reactions in the Solid State, Rapp et al," *Metallurgical Transactions,* vol. 4, Mar. 1973, pp. 1283–1292.

*Primary Examiner*—Allan M. Lieberman

*Attorney, Agent, or Firm*—Andrew Alexander; John P. Taylor

[57] ABSTRACT

An improved inert electrode composition is suitable for use as an inert electrode in the production of metals such as aluminum by the electrolytic reduction of metal oxide or metal salt dissolved in a molten salt bath. The composition comprises one or more metals or metal alloys and metal compounds which may include oxides of the metals comprising the alloy. The alloy and metal compounds are interwoven in a network which provides improved electrical conductivity and mechanical strength while preserving the level of chemical inertness necessary for such an electrode to function satisfactorily.

25 Claims, 8 Drawing Figures

FIG. 1
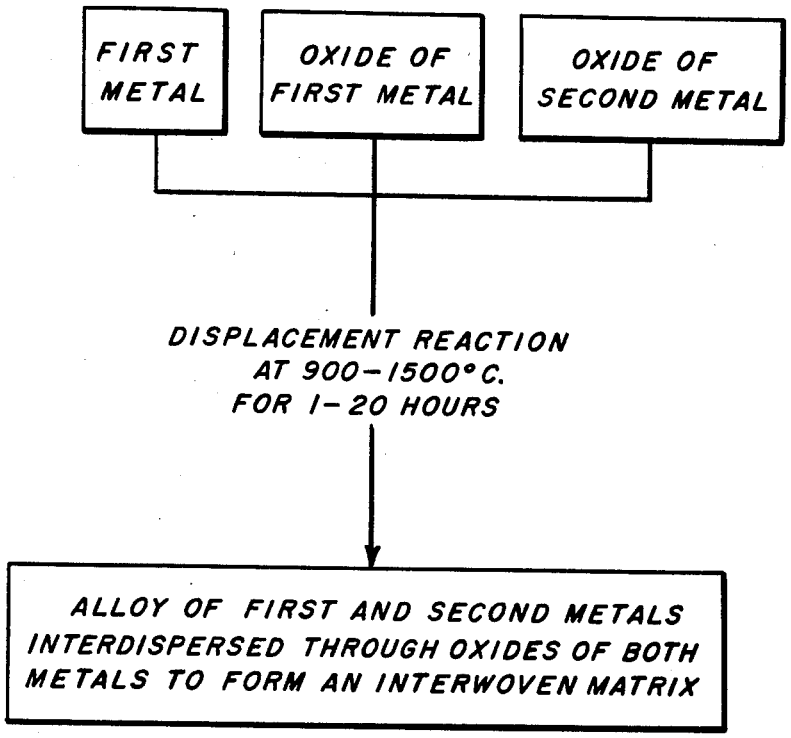
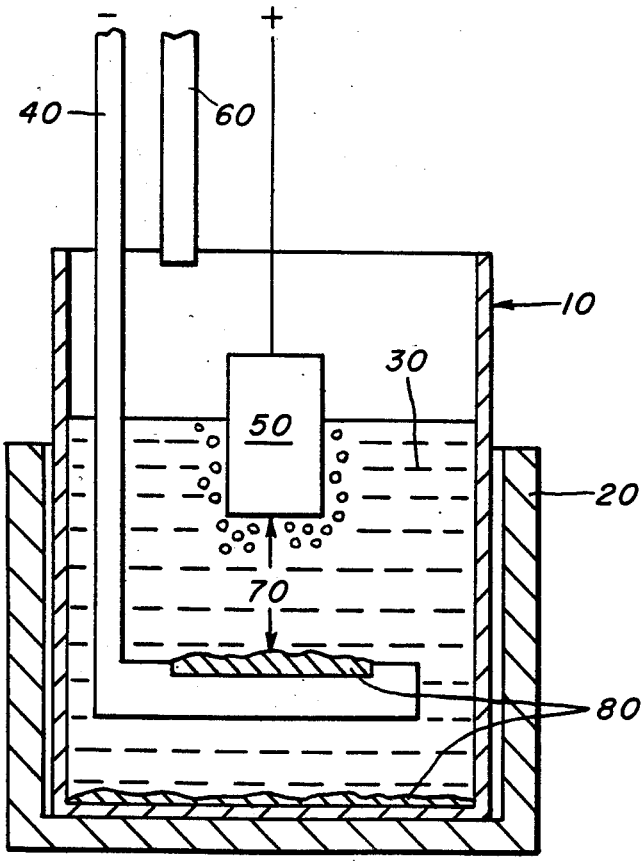
FIG. 2

75 X

20Fe, 60NiO, $20Fe_3O_4$, isostatically pressed and sintered at 1350°C. Approximately 21 vol % NiFe alloy present; density 5.5 g/cc.

75 X

20Fe, 60NiO, $20Fe_3O_4$, uniaxially pressed at 25,000 psi, sintered at 1350°C in argon. Approximately 16 vol % NiFe alloy present; density 5.4 g/cc.

NICKEL 500 X

500 X

OXYGEN 500 X

IRON 500 X

METHOD OF MAKING COMPOSITION SUITABLE FOR USE AS INERT ELECTRODE HAVING GOOD ELECTRICAL CONDUCTIVITY AND MECHANICAL PROPERTIES

The Government has rights in this invention pursuant to Contract No. DE-FC07-80CS40158 awarded by the Department of Energy.

CROSS REFERENCE TO RELATED APPLICATIONS

This application is a division of Application Ser. No. 423,673, filed Sept 27, 1982, and now issued as U.S. Pat. No. 4,454,015.

BACKGROUND OF THE INVENTION

This invention relates to the production of metals such as aluminum, lead, magnesium, zinc, zirconium, titanium, silicon and the like by the electrolytic reduction of oxides or salts of the respective metals. More particularly, the invention relates to an inert type electrode composition useful in the electrolytic production of such metals.

Conventionally, metals such as aluminum, for example, are produced by electrolysis of alumina dissolved in molten salts using carbon electrodes. However, the oxygen released by the reduction of alumina reacts with the carbon electrodes to form carbon dioxide resulting in the decomposition and consumption of the carbon electrodes. As a result, about 0.33 pounds of carbon must be used for every pound of aluminum used. Carbon such as that obtained from petroleum coke is normally used for such electrodes. However, because of the increasing costs of such cokes, it has become economically attractive to find a new material for the electrodes. A desirable material would be one which would not be consumed, i.e. resistant to oxidation, and which would not be attacked by the molten salt bath. In addition, the new material should be capable of providing a high energy efficiency, i.e. have a high conductivity, should not affect the purity of metal, should have good mechanical properties and should be economically acceptable with respect to the cost of raw material and with respect to fabrication.

Numerous efforts have been made to provide an inert electrode having the above characteristics but apparently without the required degree of success to make it economically feasible. That is, the inert electrodes in the art appear to be reactive to an extent which results in contamination of the metal being produced as well as consumption of the electrode. For example, U.S. Pat. No. 4,039,401 reports that extensive investigations were made to find nonconsumable electrodes for molten salt electrolysis of aluminum oxide, and that spinel structure oxides or perovskite structure oxides have excellent electronic conductivity at a temperature of 900° to 1000° C., exhibit catalytic action for generation of oxygen and exhibit chemical resistance. Also, in U.S. Pat. No. 3,960,678, there is disclosed a process for operating a cell for the electrolysis of aluminum oxide with one or more anodes, the working surface of which is of ceramic oxide material. However, according to the patent, the process requires a current density above a minimum value to be maintained over the whole anode surface which comes in contact with the molten electrolyte to minimize the corrosion of the anode. Thus, it can be seen that there remains a great need for an electrode which is substantially inert or is resistant to attack by molten salts or molten metal to avoid contamination and its attendant problems.

It has been proposed that an inert electrode be constructed using ceramic oxide compositions having a metal powder dispersed therein for the purpose of increasing the conductivity of the electrode. For example, when an electrode composition is formulated from NiO and $Fe_2O_3$, a highly suitable metal for dispersing through the composition is nickel which may increase the conductivity of the electrode by as much as 30 times.

However, it has been found that the search for inert electrode materials possessing the requisite chemical inertness and electrical conductivity is further complicated by the need to preserve certain mechanical characteristics which may be either enhanced or impaired by modifications to enhance the chemical resistance or electrical conductivity. For example, the electrode should possess certain minimum mechanical strength characteristics tested by the modulus of rupture, fracture toughness and expansion and resistance to thermal shock of the electrode material as well as the ability to weld electrical connections thereto must also be taken into account. An article entitled "Displacement Reactions in the Solid State" by R.A. Rapp et al, published May 1973, in Volume 4 of Metallurgical Transactions, at pages 1283–1292, points out the different morphologies which can result from the addition of a metal or metal alloy to an oxide mixture. The authors show that some additions result in layers of metal or metal oxides while others form aggregate arrangements which may be lamellar to completely interwoven. The authors suggest that interwoven-type microstructures should be ideal for the transfer of stresses and resistance to crack propagation and demonstrated that such were not fractured by rapid cooling. The authors suggested that such an interwoven structure would be useful in the preparation of porous electrodes for fuel cells or as catalysts for reactions between gases by selective dissolution of either the metal or oxide phase.

In accordance with the invention, an inert electrode composition having improved electrical conductivity is provided by contacting a combination of metal and metal oxides, oxygen-containing compounds or metal compounds, at an elevated temperature resulting in a displacement reaction to form an interwoven network of metal oxides and metal alloy. In a preferred embodiment, metal compounds which include a nickel compound and iron are reacted to form an interwoven matrix which includes oxides of nickel and iron and an alloy which contains nickel and iron.

BRIEF DESCRIPTION OF THE DRAWINGS

FIG. 1 is a flowsheet illustrating the invention.

FIG. 2 is a schematic representation of an electrolytic cell showing the inert electrode of the invention being tested.

DETAILED DESCRIPTION OF THE INVENTION

Figure 4:
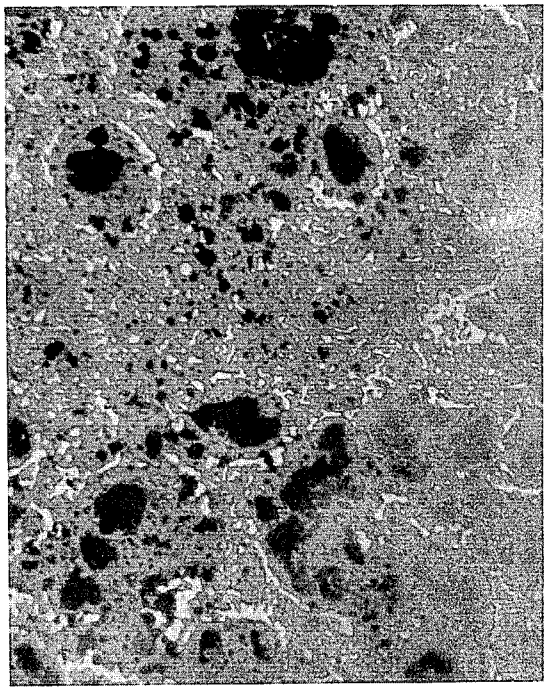
FIG. 4 is a photomicrograph of another electrode made in accordance with the invention.

The invention provides an inert electrode composition suitable for use in the production of metals such as aluminum by electrolytic reduction of their oxides or salts in a molten salt bath. The electrode composition provides a high degree of chemical inertness to attack by the bath while providing good electrical conductivity and satisfactory mechanical properties.

The electrode composition of the present invention is particularly suited for use an an anode in an aluminum producing cell. In one preferred aspect, the composition is particularly useful as an anode for a Hall cell in the production of aluminum. That is, when the anode is used, it has been found to have very high resistance to bath used in a Hall cell. For example, the electrode composition has been found to be resistant to attack by cryolite ($Na_3AlF_6$) type electrolyte baths when operated at temperatures around 950°-1000° C. Typically, such baths can have a weight ratio of NaF to $AlF_3$ in a range of about 1.0:1 to 1.4:1. Also, the electrode has been found to have outstanding resistance to lower temperature cryolite type baths where $NaF/AlF_3$ ratio can be in the range of from 0.5 up to 1.1:1. Low temperature baths may be operated typically at temperatures of about 800° to 850° C. utilizing the electrode composition of the invention. While such baths may consist only of $Al_2O_3$, NaF and $AlF_3$, it is possible to provide in the bath at least one halide compound of the alkali and alkaline earth metals other than sodium in an amount effective for reducing the operating temperature. Suitable alkali and alkaline earth metal halides are LiF, $CaF_2$ and $MgF_2$. In one embodiment, the bath can contain LiF in an amount between 1 and 15%.

A cell of the type in which anodes having compositions in accordance with the invention were tested is shown in FIG. 2. In FIG. 2, there is shown an alumina crucible 10 inside a protection crucible 20. Bath 30 is provided in the alumina crucible and a cathode 40 is provided in the bath. An anode 50 having an inert electrode also in the bath is shown. Means 60 is shown for feeding alumina to the bath. The anode-cathode distance 70 is shown. Metal 80 produced during a run is represented on the cathode and on the bottom of the cell.

The novel electrode composition is formed by reacting together two or more metal-containing reactants to provide an in situ displacement reaction whereby the metal or metals in one reactant displace a certain amount of the metal in the other reactant, and the displaced metal then may form an ally or alloys with one or more of the metals present. The first reactant is selected from the class consisting of a metal and a metal compound. The second reactant is a metal compound. In accordance with the invention, the resultant alloy or alloys or a free metal may be dispersed throughout the material in an interwoven matrix with the metal compounds resulting in a composition having enhanced electrical conductivity and mechanical strength.

Not all combinations of metals and metal compounds will, by displacement reaction, form a composition whose morphology is that of an interwoven matrix of free metal or alloy and metal compounds comprising metal salts or metal oxides. The Rapp et al article entitled "Displacement Reactions in the Solid State", previously referred to and specifically incorporated herein by reference, describes the displacement reaction of nickel and copper oxide as forming a layered product morphology consisting respectively of copper oxide, copper, nickel oxide and nickel layers. Similar reaction is disclosed for cobalt and copper oxide, while iron and copper oxide are said to form a lamellar-aggregate arrangement wherein layers of metallic copper and metallic iron are separated by a layer having a mixture of metallic copper and iron oxide.

In contrast, the displacement reaction, for example, of iron and nickel oxide results in small outer layers of iron and nickel oxide, respectively, separated by a large layer comprising what is described as two substantially completely interwoven and continuous phases or an interwoven aggregate of a nickel-iron alloy and nickel-iron oxide.

Thus, the metals and metal compounds useful in the invention include those metals and metal compounds which will react to provide free metal or form an alloy or alloys dispersed throughout the reaction product in an interwoven matrix with the resultant metal compounds resulting from the reaction.

While the invention will be illustrated by the use of one or more metals reacting with one or more metal oxides, the term "metal compounds" as used herein is intended to embrace not only metal oxides but also other materials containing oxygen as well. Examples of such include, for example, oxyborides, oxynitrides and oxyhalides. In addition, the use of non-oxygen compounds such as, for example, the use of metal borides, nitrides, carbides, halides and sulfides, should also be deemed to be within the scope of the term "metal compounds" as used herein.

The initial reactants in the displacement reaction may include more than one metal as well as more than one metal compound. For example, in the preferred embodiment of the invention in which a nickel-iron alloy is interwoven with nickel-iron oxides, the reactants comprise metallic iron and oxides of both iron and nickel. This reaction can be illustrated by the following formula:

$$Fe + NiO + Fe_3O_4 \rightarrow \underset{\text{alloy}}{\text{Ni-Fe}} + Ni_xFe_{1-x}O + Ni_yFe_{3-y}O_4$$

where $0<x<1.0$ and $0<y<1.0$ and preferably $0.6<x<1$ and $0.7<y<1$. In accordance with the invention, the resulting composition should contain 5-50 vol. % of the metal alloy or alloys, e.g. Ni-Fe alloy, preferably 10-35 vol. %, and most preferably 15-25 vol. %. The ratio of metals in the alloy or alloys may vary considerably. The metal compounds, which in the preferred embodiment comprise metal oxides, comprise the balance of the resulting composition. The metal compounds in the final composition will not necessarily be the same as the initial metal compound reactants, but may rather be complex reaction products of the displacement reaction. For example, when metallic iron is reacted with iron oxide and nickel oxide, as show in the formula above, mixed oxides of nickel and iron are formed.

Figure 5A:
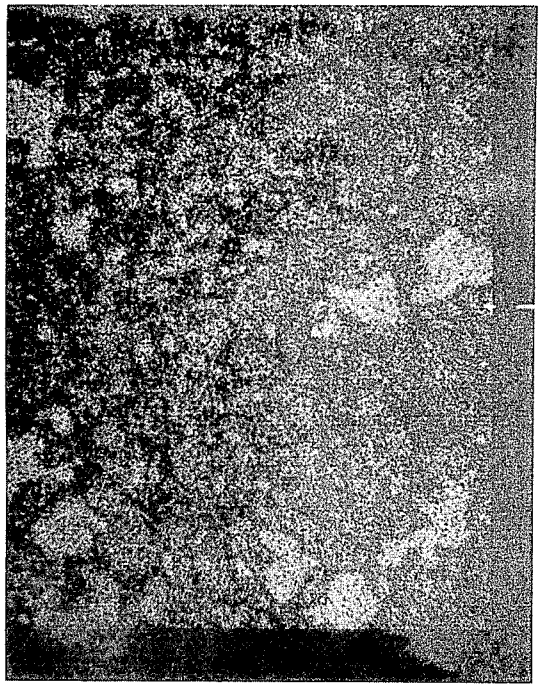
FIG. 5*a* is a photomicrograph X-ray image for nickel corresponding to FIG. 5.
Figure 5:
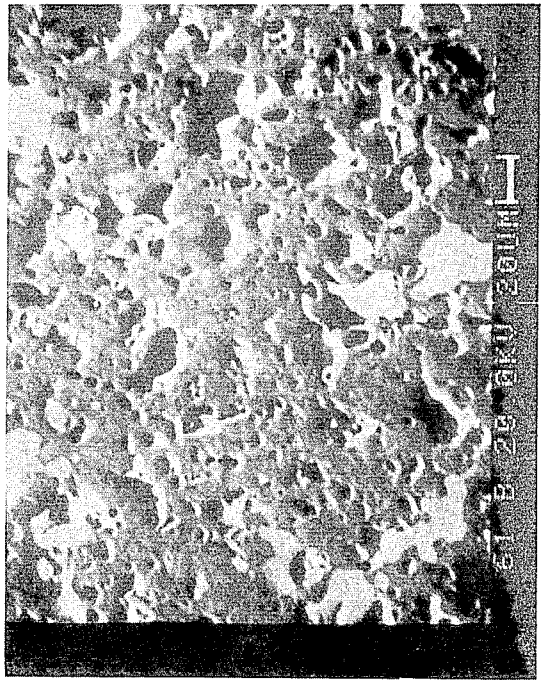
FIG. 5 is a photomicrograph back scattered electron image at 500X of an Ni-Fe-O electrode composition in accordance with the invention showing substantially continuous metallic areas throughout the ceramic matrix.
Figure 6A:
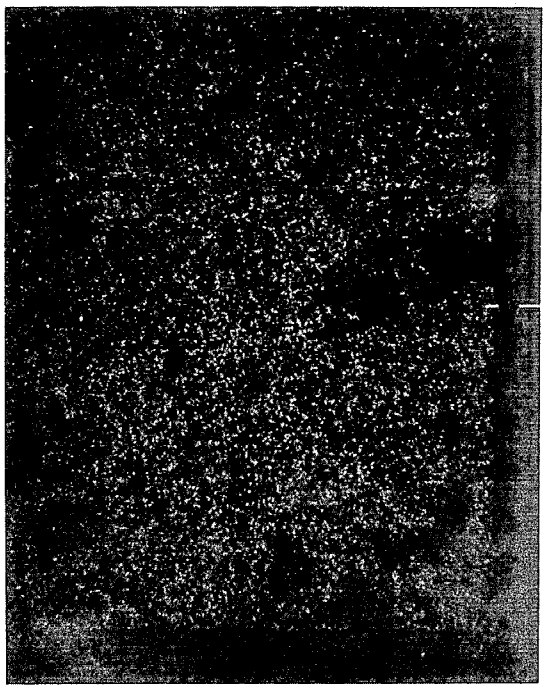
FIG. 6*a* is a photomicrograph X-ray image for oxygen corresponding to FIG. 5.
Figure 6:
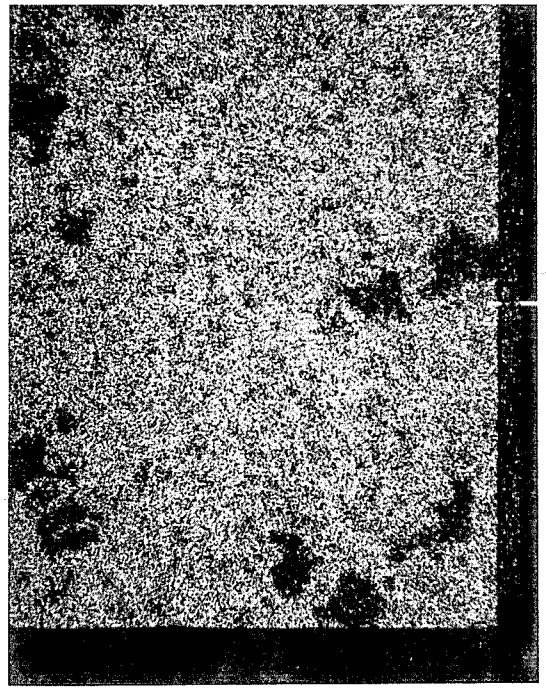
FIG. 6 is a photomicrograph X-ray image for iron corresponding to FIG. 5.

Referring to FIG. 5, there is shown a photomicrograph showing a backscattered electron image from an inert electrode composition containing 9.53 wt. % Fe, 50.97 wt. % NiO and 39.5 wt. % $Fe_3O_4$. This photograph shows the nature of or continuity of the dispersed or interwoven alloy of a cermet in accordance with the invention. FIGS. 5*a*, 6 and 6*a* show corresponding Ni, Fe and O containing areas of the cermet of the invention. Examination of the figures confirms the absence of oxygen in the metallic areas, and FIGS. 5*a* and 6 confirm the presence of large amounts of Ni and small amount of Fe in the metallic alloy.

The initial reactants used to form the above composition should comprise 5–35 wt. % of one or more metals, preferably 5–30 wt. %, with the balance comprising one or more metal compounds. In the preferred embodiment, the reactants comprise 5–30 wt. % Fe metal, 0–25 wt. % $Fe_3O_4$, 50–70 wt. % NiO and 0–35 wt. % of one or more additional metal compounds, as will be described below.

The reactants can be initially blended by mixing powders of the reactants screened to below 100 mesh (Tyler Series) and uniaxially die pressed at 10–30,000 psi. The initial composition is then reacted by sintering, preferably in an inert atmosphere, at from 900°–1500° C., preferably 1150°–1350° C. for a period of 1 to 20 hours. Longer periods of time could be used but are not necessary and, therefore, are not economical. If non-oxygen bearing metal compounds are used as the non-metallic reactants, a controlled oxygen atmosphere may be substituted for the inert atmosphere to permit formation in situ of a controlled amount of oxides in the final composition.

The initial reactants may also be formed into an electrode using isostatic pressing techniques well known to those skilled in the art. The electrode is then reaction sintered using the same parameters just discussed for uniaxially pressed electrodes.

In another embodiment, the reactants may be hot pressed to form the electrode while reacting the composition. In this embodiment, the powdered initial reactants are uniaxially pressed at a pressure of about 1,000 to 3,000 PSI for about 15 minutes to one hour at a temperature of about 750°–950° C. Care must be exercised, in the practice of this embodiment, in selection of die materials which will be inert to the displacement reaction taking place within the dies during the formation of the electrode. For example, the use of boron nitride-coated dies has been successfully attempted. It should be further noted here that hot isostatic pressing can also be used in this embodiment.

As mentioned above, additional metal compounds, such as additional metal oxides, may be added to the original reactants if desired to alter some of the chemical or electrical characteristics of the resultant composition. For example, when iron is reacted with iron oxide and nickel oxide, it has been found that the resultant composition, while providing an inert electrode having satisfactory to excellent electrical and mechanical properties in an electrolytic cell, yields aluminum pot metal which may, in certain instances, have an undesirably high Fe or Ni level.

However, the use of up to 30 wt. % of one or more other metal compounds, including oxides such as, for example, compounds of Al, Mg, Ca, Co, Si, Sn, Ti, Cr, Mn, Nb, Ta, Zr, Cu, Li and Y appears to result in the formation of compounds from which the iron or the nickel component can be more difficult to leach or dissolve during subsequent function as an inert electrode in an electrolytic cell for production of metal such as aluminum.

If desired, after formation of the novel composition of the invention, an inert electrode assembly, including connectors to be joined thereto, can be frabricated therefrom suitable for use in a cell for the electrolytic reduction of metal such as aluminum. Ceramic fabrication procedures well known to those skilled in the art can be used to fabricate such electrodes in accordance with the present invention.

Also, in electrolytic cells, such as Hall cells, claddings of the composition of the invention may be provided on highly conductive members which may then be used as anodes. For example, a composition as defined by the formulas referred to hereinabove may be sprayed, e.g. plasma sprayed, onto a conductive member to provide a coating or cladding thereon. This approach can have the advantage of lowering or reducing the length of the resistance path between the highly conductive member and the molten salt electrolyte and thereby significantly lowering the overall resistance of the cell. Highly conductive members which may be used in this application can include metals such as stainless steels, nickel, iron-nickel alloys, copper and the like whose resistance to attack by molten salt electrolyte might be considered inadequate yet whose conductive properties can be considered highly desirable. Other highly conductive members to which the composition of the invention may be applied include, in general, sintered compositions of refractory hard metals including carbon and graphite.

The thickness of the coating applied to the conductive member should be sufficient to protect the member from attack and yet be maintained thin enough to avoid unduly high resistances when electrical current is passed therethrough. Conductivity of the coating should be at least 0.01 $ohm^{-1}cm^{-1}$.

The following examples will serve to further illustrate the invention.

EXAMPLE I

A composition consisting of 20 wt. % $Fe_3O_4$, 60 wt. % NiO and 20 wt. % Fe metal as powders of −100 mesh (Tyler Series) was uniaxially die pressed at 172 MPa into 2.5 cm (1 inch) diameter rods and sintered in an argon atmosphere at 1350° C. for 14 hours.

Figure 3:
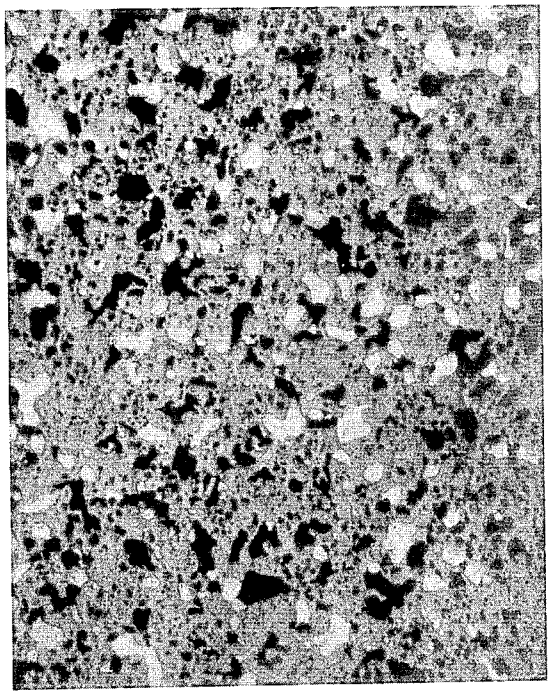
FIG. 3 is a photomicrograph of an electrode made in accordance with the invention.

FIGS. 3 and 4 are photomicrographs of the resultant reaction composition which show the dispersal of the Ni-Fe alloy with the Ni-Fe oxides.

Six of the sintered rods were then partially reduced by contacting one end of the rod with carbon (graphite) in an argon atmosphere by raising the temperature at 100° C. per hour up to 800° C. for 16 hours and then raised to 960° C. at the same rate and then held at 960° C. for 5 hours, then cooled to 800° C. at 100° C. per hour and held at 800° C. for an additional 16 hours. The rods were then cooled to room temperature at 100° C. per hour. Ni-200 rod was then welded to the reduced end by TIG welding.

The thermal expansion of the composition under vacuum was then measured and determined to be $10^{-6}$ cm/cm/°C. at 1000° C. which was deemed to be satisfactory.

A second set of electrodes was also formed using the same powder reactants. The reactants, however, were hot pressed for 30 minutes at a temperature of about 850° C. and a pressure of 2,000 PSI in a press containing dies which were coated with boron nitride.

The electrical conductivity of the electrodes was then measured together with a carbon electrode and an electrode made using 7.6 wt. % Fe, 60.93 wt. % NiO and 31.4 wt. % $Fe_3O_4$. The results are listed in Table I below.

TABLE I

| Sample Composition | Conductivity in 1/ohm-cm (at 1000° C.) |
|---|---|
| 1. Carbon | 250 |
| 2. 20% Fe, 60% NiO, 20% $Fe_3O_4$ | 100 (cold pressed) |
| 3. 20% Fe, 60% NiO, 20% $Fe_3O_4$ | 700 (hot pressed) |
| 4. 7.6% Fe, 60.93% NiO, 31.47% $Fe_3O_4$ | 14 |

A test was also run to determine the effect of current density on the current efficiency and the amounts of Fe and Ni in the resultant aluminum metal. The results are shown in Table II.

TABLE II

| Anode Current Density (Amps/cm$^2$) | Current Efficiency | Bath Ratio | Aluminum Analysis (wt. %) Fe | Ni |
|---|---|---|---|---|
| 1.0* | 88 | 1.00–1.3 | 0.23 | 0.03 |
| 1.0 | 67 | 1.11–1.17 | 0.57 | 0.01 |
| 1.0 | 95 | 1.05–1.16 | 0.34 | 0.023 |
| 1.5* | 87 | 1.13–1.15 | 0.15 | 0.017 |
| 1.5 | 77 | 1.15–1.27 | 0.25 | 0.01 |
| 2.0 | 97 | 1.14–1.30 | 0.16 | 0.03 |

*These tests were conducted in a fresh bath. The other baths were tapped from a conventional production cell. The ratios are the weight percent NaF to $AlF_3$ amounts in the bath.

Five of the rods were then evaluated as anodes in a conventional Hall cell operating at 960° C. with 5% $CaF_2$. The results are shown in Table III.

TABLE III

| Anode | Time (hours) | Current Efficiency | Bath Ratios | Aluminum Analysis (wt. %) Fe | Ni |
|---|---|---|---|---|---|
| 1 | 33 | 88 | 1.09–1.3 | 0.23 | 0.02 |
| 2 | 37 | 90+ | 1.12–1.3 | 0.1 | 0.01 |
| 3 | 42 | 56 | 1.03–1.2 | 0.6 | 0.09* |
| 4 | 24 | 86 | 1.14–1.0 | 0.48 | 0.11** |
| 5 | 68 | 78 | 1.16–1.11 | 0.85 | 0.22** |

*The electrode eventually shorted to the metal pad.
**These runs were conducted using a commercial Hall cell bath.

The electrodes were all examined after the test to determine breakage, cracks, oxidation, etc., to determine both the mechanical as well as the chemical inertness (which is also indicated by the amount of Fe and Ni in the aluminum produced by the cell).

In each instance, the electrodes appeared to have withstood the bath operating temperatures without apparent significant mechanical or chemical degradation. The current efficiencies and conductivity measurements indicated satisfactory electrical properties as well.

An inert electrode was fabricated in accordance with the invention by reaction sintering a composition containing 60 wt. % NiO, 20 wt. % Fe, 18 wt. % $Fe_3O_4$ and 2 wt. % $Al_2O_3$ under the same conditions as described in Example I. The resulting electrode was placed in operation for 28 hours in a cell similar to that shown in FIG. 2. The aluminum metal produced using this electrode contained only 0.13 wt. % Fe and 0.015 wt. % Ni. Optical microscopy of the electrode after the test revealed that a very thin oxide layer (0.2 mm) was formed. It was also noted that the electrode appeared to have formed an (Ni, Fe, Al)$_3O_4$ spinel around the bottom corner of the electrode.

As in the tests performed in Example I, the anode appeared to have performed well with regard to mechanical properties and chemical stability as well as satisfactory electrical properties.

Thus, the inert electrode composition of the invention possesses satisfactory chemical, mechanical and electrical properties necessary for use in the production of metal by electrolytic reduction of metal oxides or salts in a molten salt bath.

What is claimed is:

1. A process for the production of an inert electrode composition for use in the production of metal by the electrolytic reduction of a metal compound which comprises: reacting at least one preselected metal compound powder and at least one other reactant powder selected from the class consisting of a metal and a metal compound, said preselected metal compound and said other reactant being capable of reacting by a displacement reaction to form from 5 to 50 vol. % of an alloy of a metal in said other reactant with another metal present in said preselected metal compound, or a free metal, with the balance consisting of one or more metal compounds, said alloy or free metal being dispersed through said one or more metal compounds formed in said displacement reaction in an interwoven matrix whereby an inert electrode made from said composition is characterized by enhanced conductivity and mechanical strength.

2. The process of claim 1 wherein said reactants are uniaxially die-pressed at a pressure of 10,000 to 30,000 PSI prior to reacting to form said composition.

3. The process of claim 1 wherein said reactants are isostatically pressed prior to reacting to form said composition.

4. The process of claim 2 wherein said other reactant and said one or more metal compounds are reacted after pressing at a temperature of from 900° to 1500° C. for a period of from 1 to 20 hours.

5. The process of claim 1 wherein said reactants are hot pressed at a pressure of 1000 to 3000 PSI and a temperature of from 750° to 950° C. for from 15 minutes to one hour to form the electrode while reacting the composition.

6. The process of claim 5 wherein said electrode is formed using dies which will not react with the reactants placed therein.

7. The process of claim 4 wherein said other reactant is a metal.

8. The process of claim 7 wherein from 10 to 25 wt. % of the initial mixture of one or more metal compounds and metal consists of the metal.

9. The process of claim 8 wherein at least one of said metal compounds is an oxygen-bearing compound.

10. The process of claim 9 wherein at least one of said oxygen-bearing compounds is a metal oxide.

11. The process of claim 8 wherein none of said metal compounds contains any oxygen and a predetermined amount of oxygen gas is present during said reaction to form a metal oxide with at least one of said metals.

12. The process of claim 8 wherein from 50 to 70 wt. % of the initial mixture consists of the oxide of said second metal forming the alloy with said metal.

13. The process of claim 12 wherein said metal and said oxide of said second metal react to form an oxide which includes said metal and an alloy containing said metal and said second metal.

14. The process of claim 12 wherein an oxide of said metal is also present in the initial mixture prior to reaction.

15. The process of claim 12 wherein said metal consists of iron.

16. The process of claim 12 wherein said oxide of said second metal consists of nickel oxide.

17. The process of claim 12 wherein metallic iron and nickel oxide react to displace at least a portion of the nickel in said oxide, with iron and the displaced nickel forming a nickel-iron alloy, with said iron and said alloy being dispersed throughout the composition in an interwoven matrix of alloy and metal oxide.

18. The process of claim 17 wherein said initial reactants include one or more metal oxides selected from the class consisting of oxides of Al, Mg, Ca, Co, Si, Sn, Ti, Nb, Ta, Cr, Mn, Zr, Cu, Li and Y.

19. The process of forming an inert electrode composition characterized by enhanced conductivity and mechanical strength comprising the steps of:

(a) preselecting a combination of from 5–35 wt. % of at least one metal powder and from 65–95 wt. % of at least one metal oxide powder capable of entering into a displacement reaction to form a metal oxide and an alloy which is dispersed throughout the composition in an interwoven mixture of alloy and metal oxide; and (b) reacting said metal and said metal oxide at an elevated temperature for a sufficient time to form from said metal, and at least a portion of said metal in said metal oxide, an alloy which is dispersed in an interwoven matrix throughout the resultant composition.

20. The process of forming an inert electrode composition characterized by enhanced conductivity comprising the steps of:

(a) providing at least a first metal powder and at least one first metal oxide powder capable of reacting to provide an interwoven network of metals and metal oxides; and (b) reacting from 5–35 wt. % of said first metal powder and from 65–95 wt. % of said first metal oxide powder at an elevated temperature for a sufficient time to form said interwoven network of metals and metal oxides.

21. The process in accordance with claim 20 wherein said interwoven network contains at least a second metal oxide and a second metal, the second metal containing at least a portion of the metal from the first metal oxide.

22. The process of claim 1 wherein said other reactant comprises a mixture of titanium dioxide and a boron oxide.

23. A process for the production of an inert electrode composition for use in the production of metal by the electrolytic reduction of a metal compound which comprises reacting together by a displacement reaction:

(a) from 5–35 wt. % of at least one preselected reactant powder selected from the class consisting of a metal and a metal compound; and (b) from 65–95 wt. % of at least one preselected metal compound powder; said reactants being capable of reacting by a displacement reaction to form an interwoven matrix of:

(a) a metal compound; and (b) a free metal or an alloy of:

(1) a metal in said first reactant; and (2) another metal present in said at least one preselected metal compound;

dispersed through said at least one preselected metal compound in an interwoven matrix whereby an inert electrode made from said composition comprises an interwoven matrix of said metal alloy or said free metal dispersed in said at least one preselected metal compound which electrode is characterized by enhanced conductivity and mechanical strength.

24. The process of claim 23 wherein said first reactant comprises iron and iron oxide, and said second reactant comprises nickel oxide.

25. A process for the production of an inert electrode composition for use in the production of metal by the electrolytic reduction of a metal compound which comprises: reacting 5–30 wt. % Fe metal powder, 0–25 wt. % $Fe_3O_4$ powder, 50–70 wt. % NiO powder, and 0–35 wt. % of one or more additional metal compound powders by a displacement reaction to form a metal alloy dispersed through one or more metal compounds in an interwoven matrix whereby an inert electrode made from said composition is characterized by enhanced conductivity and mechanical strength.

* * * * *